United States Patent [19]

Wood

[11] 3,934,401

[45] Jan. 27, 1976

[54] SWITCH FOR ELECTRONIC WATCH

[75] Inventor: John R. Wood, San Jose, Calif.

[73] Assignee: American Microsystems, Inc., Santa Clara, Calif.

[22] Filed: Mar. 21, 1975

[21] Appl. No.: 569,824

Related U.S. Application Data

[63] Continuation-in-part of Ser. No. 407,147, Oct. 17, 1973, Pat. No. 3,884,033.

[52] U.S. Cl. ..... 58/23 R; 58/50 R; 58/85.5; 200/11

[51] Int. Cl.[2] ..... G04C 3/00; G04B 19/30; G04B 27/00; H01H 19/58

[58] Field of Search ..... 58/23 R, 50 R, 85.5; 200/11

[56] References Cited

UNITED STATES PATENTS

| | | | |
|---|---|---|---|
| 3,733,803 | 5/1973 | Hiraga et al. | 58/85.5 |
| 3,733,810 | 3/1971 | Girard | 58/85.5 |
| 3,869,586 | 3/1975 | Patz et al. | 200/11 R |

*Primary Examiner*—Edith Simmons Jackmon
*Attorney, Agent, or Firm*—Owen, Wickersham & Erickson

[57] ABSTRACT

A multi-position switch particularly adaptable for an electronic watch comprises a movable plate or disk mounted within a cup-like body and rotatable about an axis to different positions for accomplishing various setting or operating modes. Fixed contacts on the inside of the switch plate are spaced apart but electrically connected so that when the plate is rotated to certain positions relative to its central axis the contacts are aligned for engagement with a particular pair of a series of terminals located on the inside planar surface of the switch body and connected through the body to the internal circuitry of the device. The interconnection of certain pairs of terminals accomplished by the contacts activates internal circuitry of the device to produce the desired operating function or mode.

11 Claims, 16 Drawing Figures

FIG_6
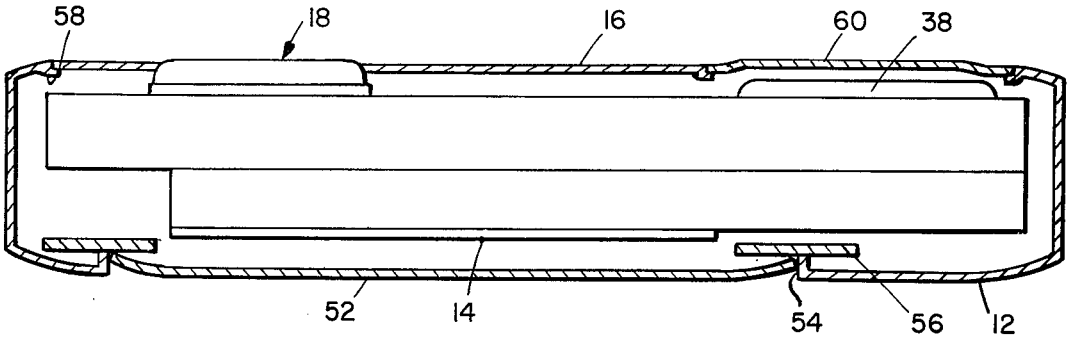
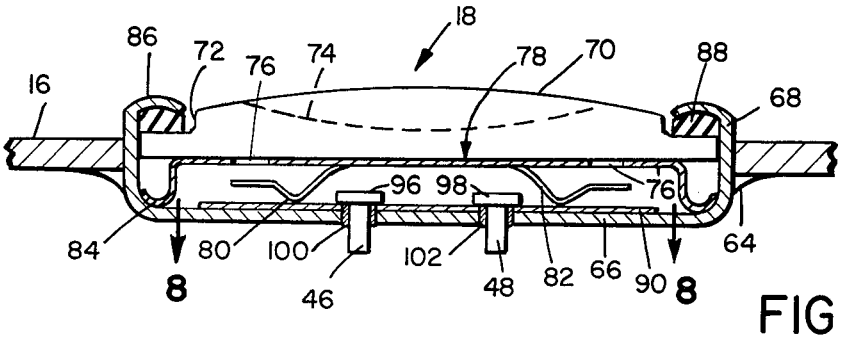
FIG_7
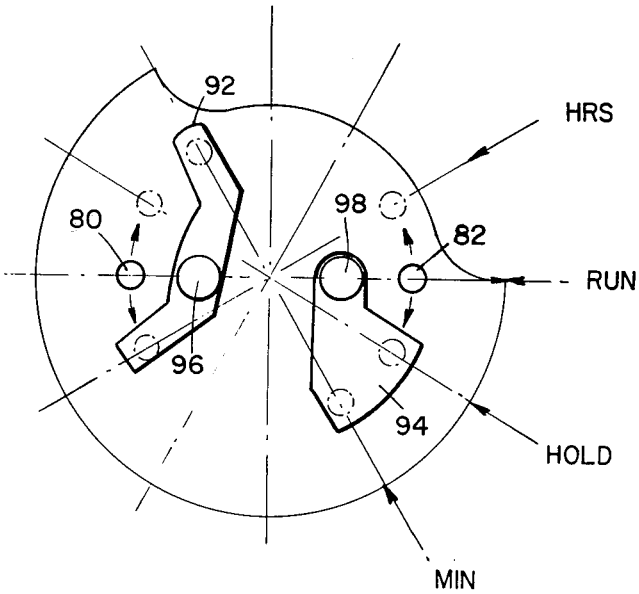
FIG_8

SWITCH FOR ELECTRONIC WATCH

BACKGROUND OF THE INVENTION

This is a continuation-in-part of application Ser. No. 407,147, filed Oct. 17, 1973 now U.S. Pat. No. 3,884,033.

This invention relates to a multi-position switch and more particularly to a switch that is well adapted for use with an electronic watch or some other relatively small electronic device.

With devices such as electronic watches, the overall size of the timing mechanism and driving circuit is a vital factor that can greatly affect its appearance, utility and marketability. One well known form of electronic watch generally comprises a crystal oscillator, an integrated circuit semi-conductor device providing the counter and driving circuitry, a coil, a battery and a digital display. In addition to these basic components a switching means is required in order to set the watch display to the proper time as when the battery is replaced. Although the integrated circuit art and other advances in the field of electronic miniaturization drastically reduced the size of the aforesaid basic watch components, it was heretofore still a serious problem to package the components in a space having overall dimensions and thickness small enough to be practical for a wrist watch of the like. Prior to the present invention, one setting switch commonly used for such watches was a standard rotary electronic switch with a stem and crown drive. This switch was relatively bulky in size and had to be accommodated inside the watch case with the other components, thereby contributing substantially to the total space required within the watch case. The present invention provides a multi-position switch for electronic watches that solves this space problem. Another form of setting means commonly used for watches was two push button switches. However, these were expensive to incorporate in a watch structure as well as being awkward to operate.

BRIEF SUMMARY OF THE INVENTION

In accordance with the principles of the present invention, my switch comprises a disk or plate located within a shallow cup-like switch body located on the front or back of the watch case rather than inside of the case. This disk is retained so as to be rotatable about its central axis to any preselected position, and on its inside surface are projections forming electrical contacts. On the inside-planar surface of the switch body are a plurality of spaced apart electrical terminals connected to conductors of a predetermined shape and these terminals extend through the switch body to the appropriate electronic circuit components within the watch case. The contacts on the back of the disk are so spaced and arranged that in various rotational positions of the disk certain of the contacts will be aligned with and contact certain combinations of the electronic terminals. Thus, when the disk or switch plate is positioned selectively the aligned contacts and terminals engage to provide electrical continuity between the engaged terminals, thereby activating the internal circuitry connected thereto to produce the desired function. For a watch using my switch the different rotational positions marked on the watch case indicate when the contacts will be aligned with the terminals for causing the hour display to advance, the minute display to advance, or to "hold" the display or to merely "run" in its normal operating mode.

It is therefore a general object of the present invention to provide an improved multi-position switch, especially for use on relatively small electronic devices such as electronic watches.

Another object of the present invention is to provide a controllable multi-position switch for electronic watches that is located outside of the interior cavity formed by the watch case, thereby providing more space within the case for the other essential watch components.

Another object of my invention is to provide a multi-position switch for electronic watches that eliminates the need for a turnable stem that projects outwardly from the case of the watch.

Yet another object of the present invention is to provide a controllable switch for electronic watches that is easy to operate, yet one that is relatively more reliable and trouble free than conventional watch switches and not easily operated inadvertently or damaged by extraneous forces that may be applied to the watch.

Still another object of the present invention is to provide a controllable multi-position switch particularly adaptable for electronic watches which can be economically manufactured with a high degree of precision.

Another more specific object of the present invention is to provide an improved switch for electrically operated devices wherein interconnected contacts on a movable disk member are alignable at different settable positions for engagement with terminal members of the switch in different combinations to provide various operational or functional modes for the circuitry connected to the switch terminal members.

Another object of my invention is to provide a structural arrangement for an electronic watch having a setting switch located on the outside of its case.

Other objects, advantages and features of my invention will become apparent from the following detailed description of one preferred embodiment.

BRIEF DESCRIPTION OF THE DRAWINGS

FIG. 6 is a further enlarged view in section of the entire watch of FIGS. 1 and 2 taken along line 6—6 of FIG. 2;

FIG. 7 is a greatly enlarged fragmentary view in section showing the switch for the watch of FIGS. 1 and 2 according to the invention;

FIG. 8 is a view taken along line 8—8 of FIG. 7 showing the relative location of the contact points and terminals for the switch in one operating position with other operating positions shown in phantom;

DETAILED DESCRIPTION OF EMBODIMENTS

Figure 1:
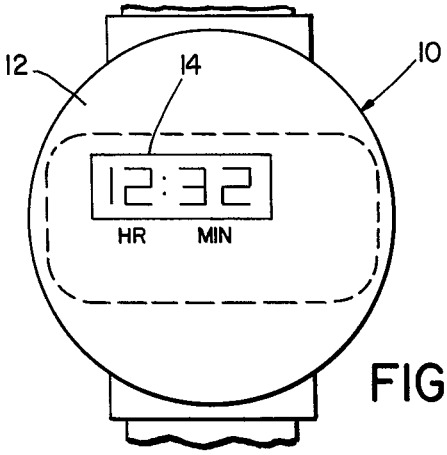
FIG. 1 is an enlarged front view of an electronic watch embodying the principles of the present invention.
Figure 2:
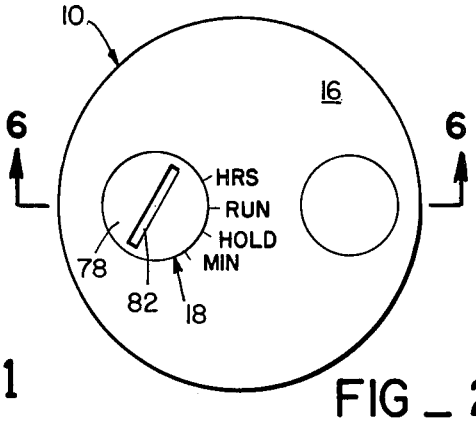
FIG. 2 is an enlarged rear view of the watch of FIG. 1.

With reference to the drawing, FIG. 1 shows an electronic watch 10 having an outer case 12 with a digital display 14 on its front side that indicates hours and minutes. The watch case which serves to house its electronic components may be made from any suitable material such as a relatively thin metal that can be formed to a desired shape. FIG. 2 shows the rear case plate 16 for the watch within which is mounted a switch 18 embodying the principles of the present invention. As shown, the rear plate is marked with appropriate indicia as circumferential locations around the switch to show the various positions for setting the hour display (HRS), the minute display (MIN), and the hold and run positions. These are the normal setting functions that heretofore were accomplished by a standard stem and crown drive connected to a conventional rotary electronic switch located inside of the watch case.

Figure 3:
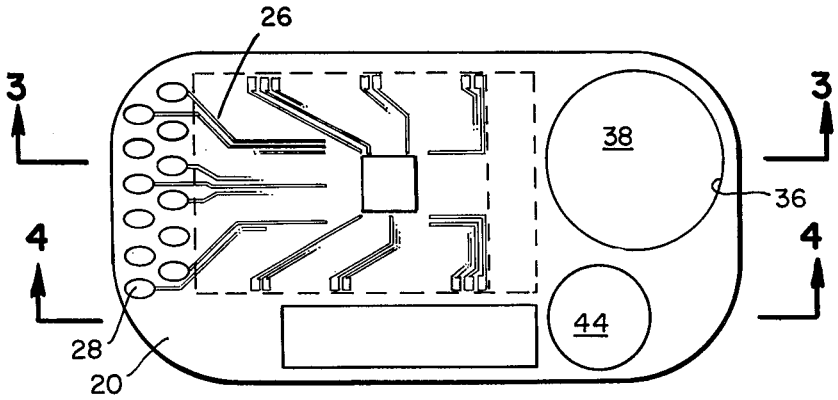
FIG. 3 is a further enlarged plan view showing the general layout of components for the watch of FIGS. 1 and 2 before they are installed in the case.
Figure 4:
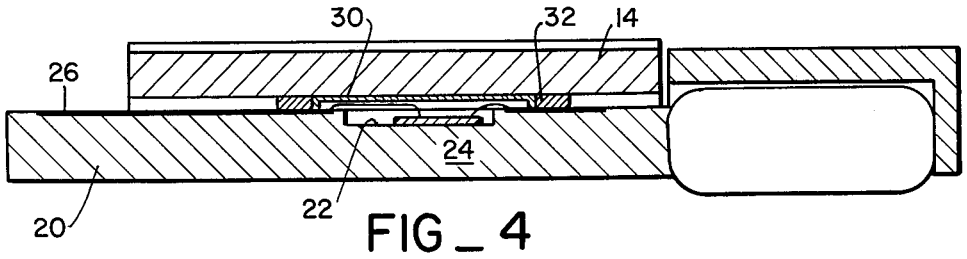
FIG. 4 is a view in section taken along line 4—4 of FIG. 3.
Figure 5:
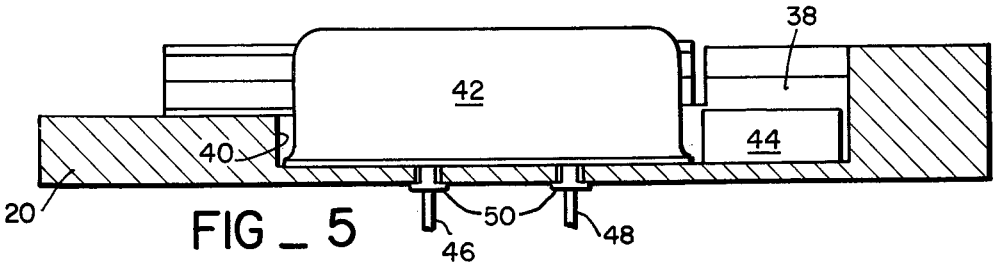
FIG. 5 is a view in section taken along line 5—5 of FIG. 3.

FIGS. 3–5 are enlarged views showing the arrangement of the various interconnected watch components for an electronic watch that must be packaged together and housed within the case 12. As shown in FIG. 3, the package is extremely compact and includes a substrate or mounting board 20 of ceramic or plastic material having a generally rectangular shape with a recess 22 on its planar top surface within which is mounted an integrated circuit semi-conductor device 24 comprising the clock logic and drive circuitry. Conductive paths 26 formed on the top surface of the substrate using standard printed circuit techniques extend to a series of connection pads 28 at one end thereof. A cover 30 fits over the recess 22 and the integrated circuit device 24 therein and is secured, as by bonding, to the substrate 20. A spacer 32 made of a suitable dielectric material is located around or at opposite ends of the cover and has the same thickness. Mounted on top of the device cover and the spacer is the digital display package 14 which is preferably one using a so-called liquid crystal material. Since the construction of such display devices is well known to those skilled in the art it need not be described here. Adjacent to one end of the display is another recess 36 in the substrate which is open on its bottom or back side, and within this recess is the battery 38 for the watch. Along one side of the display and circuit device is a third recess 40 in the substrate within which are mounted the crystal device 42 and the coil 44. Thus, it is seen that all of the essential components of the electronic watch system except the switch may be packaged as one internal assembly and these components are electrically interconnected by suitable conductors (not shown) using conventional interconnect techniques such as printed circuit conductors on the substrate with appropriate soldered or bonded connections and terminals.

Extending through the bottom surface of the substrate and from the logic circuitry are two wires 46 and 48 which are necessary for the various switching functions, namely "set hours," "set minutes," "hold" and normal "run." These wires extend through feed-through fittings 50 in the substrate to the back side of the switch 18. When the "set hours" or "set minutes" positions are activated the circuitry will advance the hour or minute portion of the display until the desired digits are displayed at which point the switch may be disconnected. In the "hold" position the display is essentially disconnected so that it will remain on one indication until a synchronizing point is reached at which time the "hold" is released and the display commences to advance normally. The "run" position is for the normal operating mode for the watch circuit.

Turning to FIG. 6, the internal components package 20 is shown installed within the case 12, as in a typical watch installation. A lens 52 at the front of the watch may be retained against the edges 54 of an opening in the front of the case 12 by a generally annular internal face plate 56. The components package is supported within the case such as by fasteners (not shown) so that the display 14 is properly positioned in back of the lens. The back case plate 16 containing the switch 18 has an edge 58 that may be retained by a pressed fit along a complementary edge of the case sidewall. A removable cover member 60 is provided in the back case plate for access to the battery 38.

In the embodiment of my invention shown in FIGS. 7 and 8, the switch 18 is made as a separate subassembled unit and is installed within an opening in the back case plate 16. It may be held in place by any suitable means such as epoxy adhesive 64 preferably placed around the inside edge of the opening. The switch comprises a cup-shaped body that may be formed from some suitable material such as beryllium copper and it has a generally planar bottom side 66 with a uniform, integral sidewall 68. Supported within the switch body is an actuator disk 70 which may be formed from a rigid, preferably non-magnetic metal such as stainless steel. This disk has a recess around its upper edge forming a circular shoulder 72 and extending diametrically across its top surface is a slot 74 capable of receiving the edge of a suitable turning instrument such as a coin. Extending from the the underside of the disk in this embodiment of the switch are a pair of spaced apart projections 76 which serve to retain and position a conductive wiper member 78 on the disk. The wiper member may be in the form of a thin sheet of metal and has a pair of contact members 80 and 82 that are bent downwardly from the underside of the disk 70 which are spaced 180° apart. At the outer edge of the wiper member are radially extending portions 84 which provide contacts with the cup-like body member. In the form shown, these edge portions are also bent downwardly to engage the bottom inner surface of the body bottom 68 just inside of its sidewall. Since the contact members 80 and 82 are all part of the wiper member and integral with the portions 84 they are also ground contacts. The disk is held within the body member by an upper edge flange 86 of the sidewall which is bent inwardly over an annular gasket member 88 that fits within the peripheral recess of the disk on the shoulder 72 formed thereby. This seal is preferably made of some non-conductive material that affords a minimum amount of frictional resistance to the actuator disk 72, such as a polytetrafluoroethylene material. Thus, the disk may be rotatable within the body member by a suitable instrument inserted within the disk slot 76. Fixed to the inside bottom surface of the switch body is a thin dielectric sheet 90 having on it a pair of terminal areas 92 and 94 each having a predetermined size and shape and formed from a layer of conductive metal. These conductive areas surround a pair of spaced apart terminals 96 and 98 which extend above insulated feed-throughs 100 and 102 located in the bottom of the switch body and are connected to the leads 46 and 48 extending into the feed-throughs. In this embodiment, it is assumed that the internal circuitry of the watch or the device being controlled is provided with a relatively large pullup resistor. Thus, when a wiper contact, which is also connected to a plus ground through the case, contacts the terminal, it will cause that terminal to assume a plus ground polarity, which will provide the same voltage level or signal to the logic circuitry. As shown in FIG. 8, the conductive areas around their respective terminals are shaped so that they may be contacted by one wiper contact in various rotational positions of the actuator disk. Assuming that the terminals are located on a diametral line on the circular sheet 90 extending through the 9:00 o'clock and 3:00 o'clock points, (assuming that the bottom surface of the watch body is a clock face) the area 92 connected to the terminal 96 extends to the 8:00 o'clock and 11:00 o'clock positions. The area 94 connected to the terminal 98 extends to the 4:00 o'clock and 5:00 o'clock positions. The terminals 96 and 98 are spaced closer to the center axis of the sheet 90 than are the contacts 80 and 82 on the wiper 78. Thus, as shown in FIG. 8, when the switch actuator disk 70 is set in the "Run" position the contacts 80 and 82 are in the 9:00 o'clock and 3:00 o'clock positions and are not contacting the terminal contact areas 92 and 94. Thus, both of the terminals are kept at the electrical state (negative) which allows the logic circuit to run in its normal operating mode. Now, if the actuator disk is turned to the "Hold" position, the contacts 80 and 82 of the wiper are at the 10:00 o'clock and 4:00 o'clock positions on the sheet 90. The contact 80 at 10:00 o'clock is not in contact with the conductive area 92 but the contact 82 is in contact with the area 94. Because of the internal pullup resistor, previously mentioned, the terminal 96 is at its normal (negative) condition, while the terminal 98 assumes a grounded or positive state, as a result of the switch. This combination produces a "hold" on the timing circuitry. When the switch disk is moved to the reset minutes positions (MIN), both contacts 80 and 82 are in contact with their respective conductive areas 92 and 94 and the terminals 96 and 98 are both at the positive or grounded state which causes the circuitry to periodically advance the minutes on the display at some predetermined clock rate. Similarly, when the switch disk is moved to the reset hours position (HRS), the contact 80 engages the area 92 and produces a positive or gounded state on the terminal 96 while the contact 82 does not contact the area 94 and leaves the terminal 98 at its negative state. This combination causes circuitry to advance the hour display section at a clocked rate to facilitate setting the watch.

Figure 9:
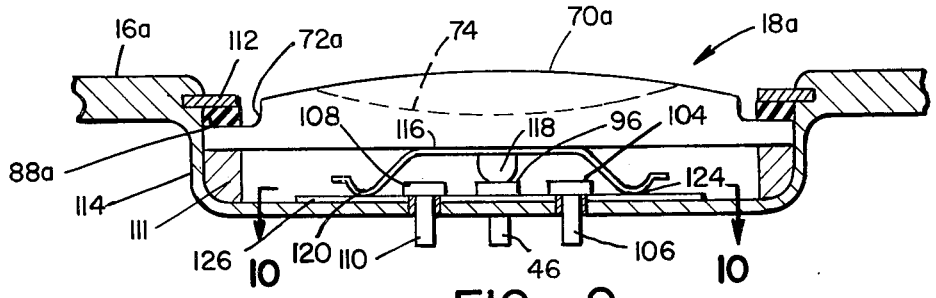
FIG. 9 is a view in section similar to FIG. 7 showing another form of switch according to my invention.
Figure 10:
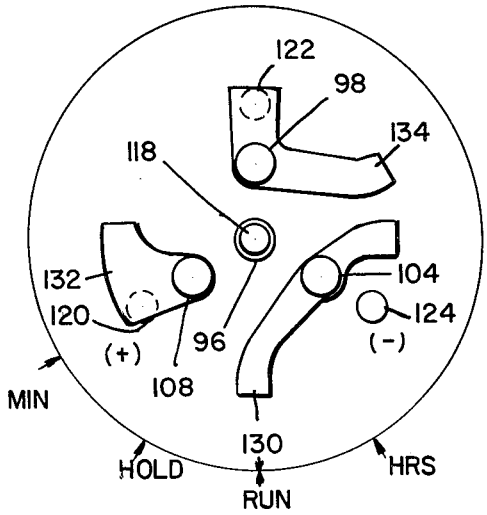
FIG. 10 is a view in section taken along line 10—10 of FIG. 9.

FIGS. 9 and 10 show another form of rotary switch 18*a* embodying the principles of my invention wherein four terminals instead of two are provided within the switch. Here, one terminal 96 connected to the logic circuitry is centrally located and the other three terminals are spaced equally from it and 120° apart, one of which is the other logic terminal 98. The second of these three terminals designated by the numeral 104 is connected to a lead 106 from the (negative) power source or battery 38 of the device. The third terminal 108 is connected to a lead 110 from an internal ground plus connection within the watch or device. Thus, in this embodiment, no pullup resistors are required for the internal circuitry and no continuous ground contact between the case and the disk must be made, as by the extended wiper portions 84. The switch 18*a* could be made as a separate unit similar to the switch 18, but as shown in FIG. 9, it may also be made with a body that is integral with a back cover plate 16*a* of the watch case. Here, the switch body is formed as a circular cup-like recess which extends inwardly from the cover plate. An actuator disk 70*a* is retained within the recess and held against an annular non-conductive spacer 111 by a split retaining ring 112 which is seated in a groove in the wall 114 of the recess. The actuator disk has a peripheral shoulder 72*a* which retains a non-conductive gasket member 88*a* that fits under the ring 112. The disk 70*a* is a conductive wiper member 116 having four bent down portions to form a central contact 118 and three other contacts 120, 122 and 124 which are spaced apart from each other and at the same distance from the central contact. These contacts are shown in phantom in FIG. 10. The spacing of these contacts is such that at different rotational positions of the actuator disk the various terminals will be connected to either a power source or to ground. The central contact 118 is aligned with and in constant contact with the central terminal 96 which is connected to the logic circuitry. Fixed to the inside bottom surface of the switch body is a dielectric layer 126 to which the four terminals 96, 98, 104 and 108 are attached. Around each of the outer terminals is a layer of conductive material formed as an area of a predetermined shape so as to provide the desired engagement between one of the disk contacts and a terminal as the actuator disk is rotated to different positions. The shape of these three conductive areas 130, 132, and 134 around the terminals 104, 108 and 98 is also shown in FIG. 10. As indicated in this view, terminal 104 and its conductive area 130 are connected to the negative power supply of the device; terminal 108 and its conductive area 132 are connected to ground potential; and terminal 98 and its conductive area 134 are connected to the internal logic or control circuitry. Thus, as shown, when the switch is in the "Run" position none of the contacts is on the power terminal 104, but they are aligned with and engaging the ground terminal 108 and the logic circuit terminals 96 and 98, thereby putting them at ground or (+) potential and causing the watch to run normally. When the switch is moved to the reset minutes position, logic terminals are connected by engaging contacts to the power terminal, thereby causing them to supply a negative signal to the logic circuit and advance the minutes display. In the "Hold" position, the terminal 98 is not connected to power and remains at its negative potential, while the logic terminal 96 is connected to ground, thereby causing the logic circuitry to "hold" the display at one point. At the reset hours "HRS" positions the polarity of the logic terminals is reversed to cause the logic circuitry to advance the hours display.

Figure 12:
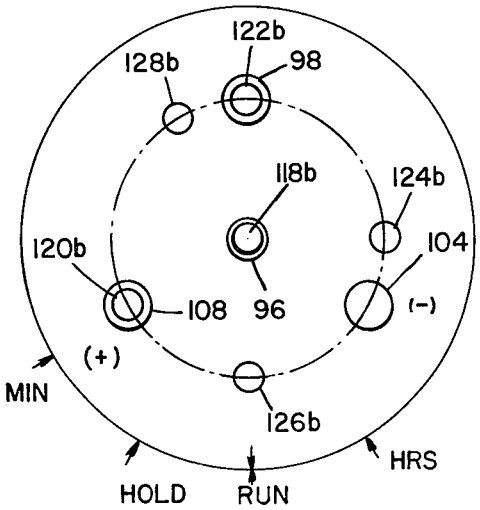
FIG. 12 is a view in section taken along line 12—12 of FIG. 11*a;*
Figure 11A:
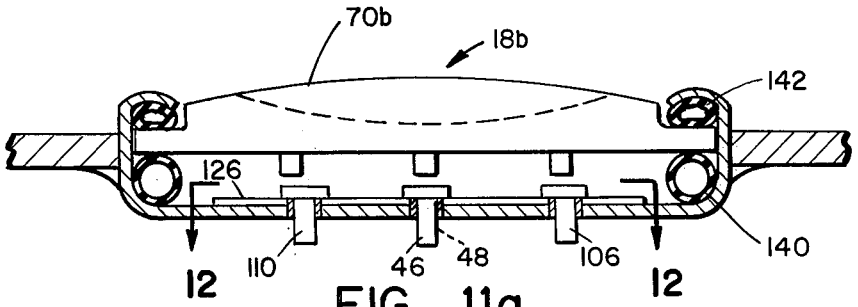
FIG. 11*a* is a view in section of still another form of my switch having a push-in connect feature.
Figure 11B:
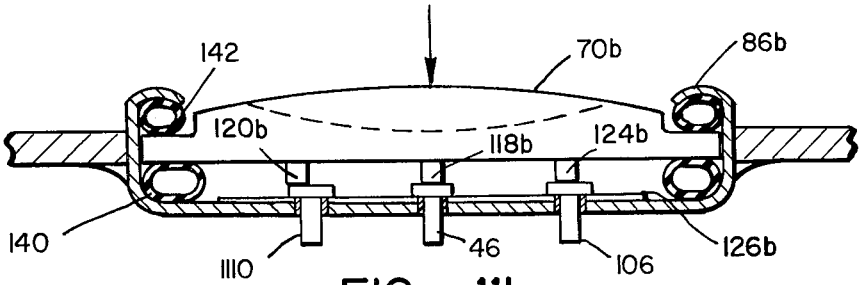
FIG. 11*b* is a view similar to FIG. 11*a* showing the switch in the activated position.

In a further modification of my invention a switch 18*b* is shown in FIGS. 11*a*, 11*b* and 12 wherein a disk actuator 70*b* is rotatable to a pre-selected position and then is movable inwardly as by thumb pressure to make contacts with terminals within the switch. Here, a switch body similar to the embodiment of FIGS. 7 and 8 is provided which is secured within a cover plate of the device. The leads 46 and 48 from the logic or control circuitry of the device and leads 106 and 110 from a ground and negative power source extend through the bottom of the switch body to four terminals 96, 98, 104 and 108 that are spaced apart and fixed to a dielectric sheet 126*b* on the body in a manner similar to the terminals of FIGS. 9 and 10. However, here, no conductive areas around the terminals are provided and each is connected to its respective lead which is surrounded by an insulating feed-through in the switch bottom. On the underside of the actuator disk 70*b* of this switch 18*b* are a series of six projections 118*b*, 120*b*, 122*b*, 124*b*, 126*b* and 128*b*, forming contacts that are spaced apart in a manner similar to the wiper contacts of the previous embodiment. Here, the contact 118*b* is the central contact and in the position shown in FIG. 12, the other contacts are located at 3:00, 6:00, 8:00, 11:00 and 12:00 o'clock locations relative to each other. The actuator disk 70*b* is supported within the switch body on a resiliently yieldable ring 140 which is made from a suitable elastomeric material. Normally, this latter ring maintains the actuator disk 70*b* up against a circular sealing gasket 142 that is retained by an annular flange 86*b* of the switch body, and in this idle or "off" position, the projecting contacts of the actuator disk 70*b* cannot engage the terminals on the bottom of the switch. When it is desired to activate the switch 18*b* the disk 70*b* is first turned to the selected position (e.g. "Hold" or "Reset Hours," etc.) and then is pressed inwardly. This causes a compression of the ring 140 and an axial movement of the disk which allows certain disk projections to make contact with aligned terminals. For example, in the "Run" position shown in FIG. 12, the contact 120*b* is in contact with the ground terminal 108, and the contacts 118*b* and 122*b* are in contact with the logic terminals 96 and 98. Thus, both are at ground potential, thereby maintaining the watch in the "Run" mode. A rotary movement and inward pressure on the disk 70*b* to another position will cause a different combination of contacts with the terminals to provide the desired operating mode as previously described. As soon as the pressure is released the contacts are broken. This version of my switch prevents the possibliity of leaving the switch closed in one position for an undesired length of time.

Figure 13:
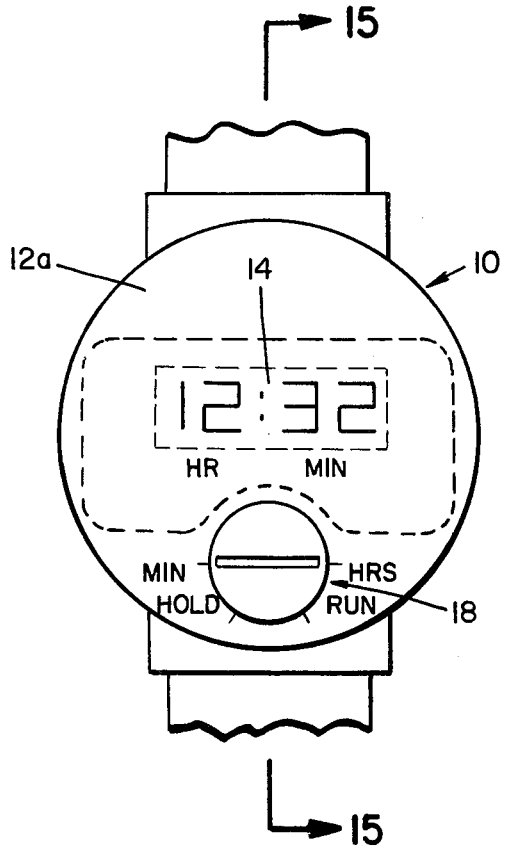
FIG. 13 is an enlarged front view of another electronic watch embodying the principles of the present invention.
Figure 14:
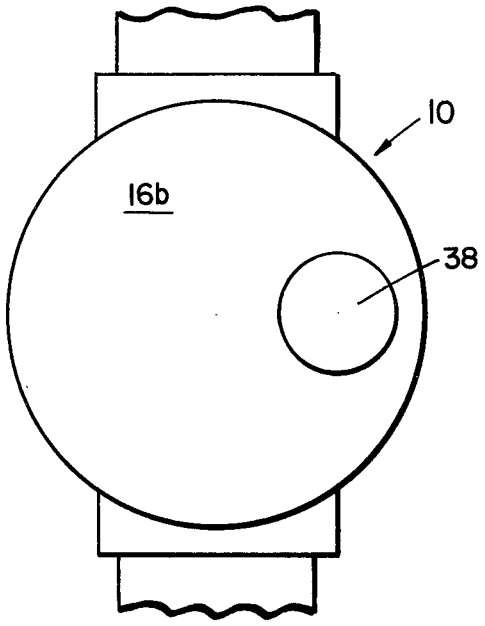
FIG. 14 is an enlarged rear view of the watch of FIG. 13.
Figure 15:
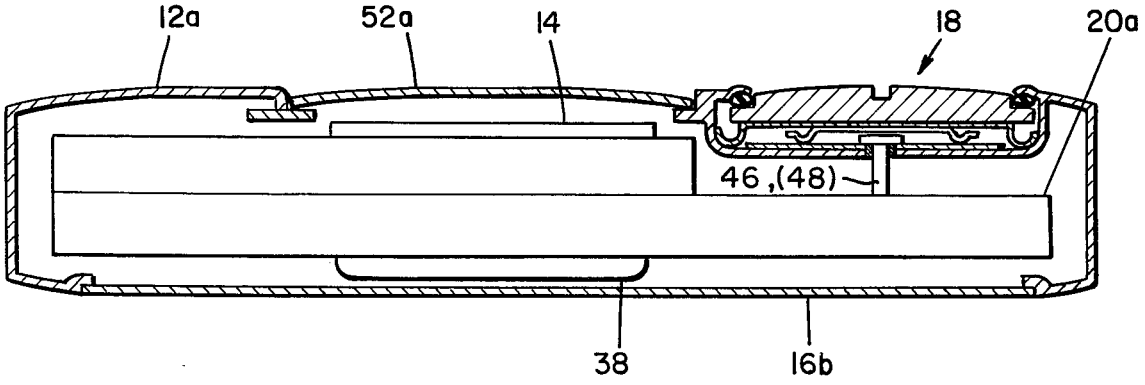
FIG. 15 is a view in section taken along line 15—15 of FIG. 13.

In some applications it is desirable to provide my switch in the front of the watch 10. Thus, the embodiment of FIGS. 13, 14 and 15 includes the switch 18 format within the front of a watch outer case 12*a* which is marked with the switch function indicia as shown. FIG. 14 shows a rear case plate 16*b* having only an access port for the battery 38. The sectional view of FIG. 15 illustrates a packaging arrangement providing a front mounting for the switch 18. The digital display 14 is viewable through a lens 52*a* which may be contoured to provide additional room for the switch on the front of the case 12*a*. Adjacent to the lens 52*a* the switch 18 is placed in a position enabling the interconnection wires 46 and 48 to connect the switch 18 with the substrate 20*a* to enable a person to perform time setting switching functions of the watch 10, while simultaneously viewing the display 14 and the switch 18. It is to be understood that any of the switch embodiments described hereinbefore is suitable for inclusion within the front of the watch case 12*a*. Thus, the discussion covering the operation and structure of the several switch embodiments of my invention will not be repeated here.

From the foregoing it should be readily apparent that the present invention provides a highly versatile switch that can be made relatively small and compact and yet provide a multiplicity of functions or switch positions. Although a limited number of terminals are employed on the illustrated examples of my switch, it is of course possible to provide additional terminals and by contacting different combinations of such terminals with contacts on the switch actuator and even greater number of switch functions may be provided. Also, while the invention has been described in terms of embodiments particularly adaptable for use in an electronic watch it may be highly useful on a wide variety of electrically operated devices, especially where a multiplicity of switch position is desired.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In an electronically operated watch having internal components including a mounting board, an electric circuit means fixed to said board, a power supply means for powering said watch connected to said circuit means, a housing means for supporting said components therein including front and rear wall members connected by a peripheral sidewall and a display means including hours and minutes indications mounted in said front member and connected to said circuit means, a rotary switch means situated in said front wall member and connected therethrough to said circuit means for setting the hours and minutes on said display means, said switch means comprising:

a relatively thin, disk-like body forming a shallow recess and extending inwardly from said front wall member, said body having a planar bottom portion partially covered by dielectric material, a plurality of terminals on said bottom portion each being exposed on the surface of said dielectric material and connected therethrough to said circuit means, a rotatable actuator disk supported within said shallow recess of said body, contact means on the underside of said actuator disk for contacting individual terminals and interconnecting preselected pairs of terminals in different combinations when the disk is placed in various rotational positions for thereby controlling said display means.

2. The timepiece as described in claim 1 wherein said disk-like body is a separately prefabricated member which is secured within an opening in said front wall member.

3. The timepiece as described in claim 1 wherein said disk-like body is formed as an integral part of said front wall member.

4. The timepiece as described in claim 3 wherein said contact means are wiper members that project downwardly from the underside of said actuator disk for engaging said terminals in different combinations at different positions of said disk.

5. The timepiece as described in claim 3 wherein said contact means are projections on the underside of said disk and resiliently yieldable means under said disk for normally preventing said contacts from engaging said terminals until external axial pressure is applied to said disk.

6. The timepiece as described in claim 4 wherein said wiper members are downwardly bent portions of a thin metal plate fixed to the underside of said actuator disk, said plate having outer edge portions forming a ground contact with said body.

7. The timepiece as described in claim 1 including a thin, dielectric sheet fixed to said planar bottom portion, said terminals being supported by and exposed along the upper surface of said sheet, and conductive area means on said sheet, connected to said terminals and extending therefrom and having a predetermined irregular shaped pattern so as to be contacted by said contact means and thereby interconnect different combinations of terminals when said actuator disk is rotated to various preselected positions.

8. The timepiece as described in claim 7 wherein there are two said terminals, each with a conductive area means on said dielectric sheet, said actuator disk is provided with two said wiper means spaced 180° apart.

9. The timepiece as described in claim 8 wherein one of said conductive area means on said dielectric sheet extends radially outwardly from one said terminal to cover a radial area of at least 30° from the center of said sheet and the other said area means has a pair of radially extending portions from its terminal which are substantially 90° apart.

10. The timepiece as described in claim 8 wherein there are three said terminals each with a conductive area means and a central terminal on said dielectric sheet, and said contact means on said actuator disk has four downwardly extending projections.

11. The timepiece as described in claim 10 wherein first and second conductive area means on said dielectric sheet both have two radially extending portions spaced about 90° apart from the center of said sheet, and a third said area means has a radially extending portion covering a segmental area of 30° from the center of said sheet.

* * * * *

UNITED STATES PATENT AND TRADEMARK OFFICE

CERTIFICATE OF CORRECTION

PATENT NO. : 3,934,401

DATED : January 27, 1976

INVENTOR(S) : John R. Wood

It is certified that error appears in the above-identified patent and that said Letters Patent are hereby corrected as shown below:

First page of patent: The serial number should read --560,824-- and not "569,824".

Signed and Sealed this

Twentieth Day of July 1976

[SEAL]

*Attest:*

RUTH C. MASON
*Attesting Officer*

C. MARSHALL DANN
*Commissioner of Patents and Trademarks*